US011629714B2

(12) United States Patent
Jo et al.

(10) Patent No.: US 11,629,714 B2
(45) Date of Patent: Apr. 18, 2023

(54) COMPRESSOR HAVING INSULATION PLATE

(71) Applicant: LG ELECTRONICS INC., Seoul (KR)

(72) Inventors: Changeol Jo, Seoul (KR); Suchul Kim, Seoul (KR); Jeonghun Kim, Seoul (KR); Sung Yong Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 206 days.

(21) Appl. No.: 17/181,109

(22) Filed: Feb. 22, 2021

(65) Prior Publication Data

US 2021/0262469 A1 Aug. 26, 2021

(30) Foreign Application Priority Data

Feb. 26, 2020 (KR) ..... 10-2020-0023784

(51) Int. Cl.
*F04C 29/04* (2006.01)
*F04C 29/06* (2006.01)
(Continued)

(52) U.S. Cl.
CPC ..... *F04C 29/04* (2013.01); *F04C 18/0215* (2013.01); *F04C 23/02* (2013.01); *F04C 2240/40* (2013.01)

(58) Field of Classification Search
CPC .... F04C 29/04; F04C 29/045; F04C 18/0215; F04C 2251/048; F04C 29/06; F04C 29/00; F01C 21/00
See application file for complete search history.

(56) References Cited

U.S. PATENT DOCUMENTS 4,278,409 A * 7/1981 Eiermann ..... H02K 15/00 418/270
5,447,420 A 9/1995 Caillat et al.
(Continued)

FOREIGN PATENT DOCUMENTS

CN 1353796 6/2002
CN 105673494 6/2016
(Continued)

OTHER PUBLICATIONS

Korean Office Action dated Jun. 8, 2021 issued in KR Application No. 10-2020-0023784.
(Continued)

*Primary Examiner* — Deming Wan
(74) *Attorney, Agent, or Firm* — Ked & Associates

(57) ABSTRACT

A compressor may include a casing, and a compression device installed inside of the casing and that compresses the refrigerant while rotating by receiving a rotational force of an electric motor through a rotational shaft. A high/low pressure separation plate may be installed at an upper portion of the compression device, and an insulation plate may be provided to block the high/low pressure separation plate and the suction tube from each other by being located therebetween. The insulation plate may reduce heat transfer between a refrigerant discharge space having a high temperature located at the upper portion of the high/low pressure separation plate and a refrigerant suction space having a relatively low temperature located at a lower portion of the high/low pressure separation plate.

19 Claims, 18 Drawing Sheets

(51) Int. Cl.

| | |
|---|---|
| ***F04C 29/00*** | (2006.01) |
| ***F01C 21/10*** | (2006.01) |
| ***F04C 23/02*** | (2006.01) |
| ***F04C 18/02*** | (2006.01) |

(56) References Cited

U.S. PATENT DOCUMENTS

| | | | | |
|---|---|---|---|---|
| 6,186,755 | B1 | 2/2001 | Haga | |
| 6,428,293 | B1 * | 8/2002 | Dewar | F04C 29/04 418/83 |
| 2003/0099564 | A1 | 5/2003 | Witham et al. | |
| 2016/0305430 | A1 * | 10/2016 | Mahure | F01C 21/10 |

FOREIGN PATENT DOCUMENTS

| | | |
|---|---|---|
| EP | 1158170 | 11/2001 |
| JP | 03-74590 | 3/1991 |
| JP | 05-149272 | 6/1993 |
| JP | H05-149272 | 6/1993 |
| JP | 2005-299496 | 10/2005 |

OTHER PUBLICATIONS

Chinese Office Action issued in Application No. 202110156863.8 dated Aug. 10, 2022.

* cited by examiner

COMPRESSOR HAVING INSULATION PLATE

CROSS-REFERENCE TO RELATED APPLICATION(S)

The present application claims priority to Korean Patent Application No. 10-2020-0023784, filed in Korea on Feb. 26, 2020, the entire contents of which is incorporated herein for all purposes by this reference.

BACKGROUND

1. Field

A compressor is disclosed herein.

2. Background

Generally, a compressor is a mechanical device used to increase pressure of a fluid or transfer a high-pressure fluid, and the compressor may be applied to a refrigeration cycle of a refrigerator or an air conditioner, for example, to compress refrigerant gas and transfer the compressed refrigerant gas to a condenser. Such a compressor is divided into a reciprocating compressor, a rotary compressor, and a scroll compressor according to a method of compressing the refrigerant gas.

Such a compressor compresses refrigerant introduced to a compression chamber using a rotational force of a motor and then discharges the refrigerant. The compressed refrigerant is collected to a refrigerant discharge space which is an inner space of an upper shell corresponding to a kind of lid, and then is discharged to the outside through a discharge tube and transferred to a condenser in a refrigeration cycle.

An upper portion (refrigerant discharge space) of the inner space of the compressor may be relatively high in temperature, and a lower portion (refrigerant suction space) of the inner space of the compressor may be relatively low in temperature, relative to a high/low pressure separation plate. This is because the compressed refrigerant is discharged to the space at the upper side of the high/low pressure separation plate. When a temperature difference between the upper space and the lower space is large, heat may be transferred to the lower space, so the temperature of the lower space may be increased. In this case, due to a rise in the temperature of the refrigerant gas introduced into the lower space, a volume efficiency of the compressor may be decreased, and as a result, efficiency of the compressor may be decreased.

To solve this problem, a compressor is proposed in U.S. Pat. No. 6,186,755, which is hereby incorporated by reference, in which a heat pipe is configured in a drive shaft at a center of the compressor and absorbs heat from the center so as to dissipate the heat to a cooling fan located at opposite sides of the drive shaft. However, the compressor has a very complex mechanical structure, which increases manufacturing costs.

In addition, a compressor is proposed in U.S. Pat. No. 5,447,420, which is hereby incorporated by reference, in which liquid refrigerant is injected into a compression chamber and latent heat produced by evaporation of the refrigerant is used to lower a temperature of compressed gas. However, the method of injecting liquid refrigerant in such a compressor makes a mechanical configuration and a control method complicated.

Further, such prior art is difficult to apply to existing compressors. Thus, existing compressors must be re-designed and manufactured, so that manufacturing costs of the compressors of each of the prior art is increased.

BRIEF DESCRIPTION OF THE DRAWINGS

Embodiments will be described in detail with reference to the following drawings in which like reference numerals refer to like elements, and wherein.

DETAILED DESCRIPTION

Figure 1:
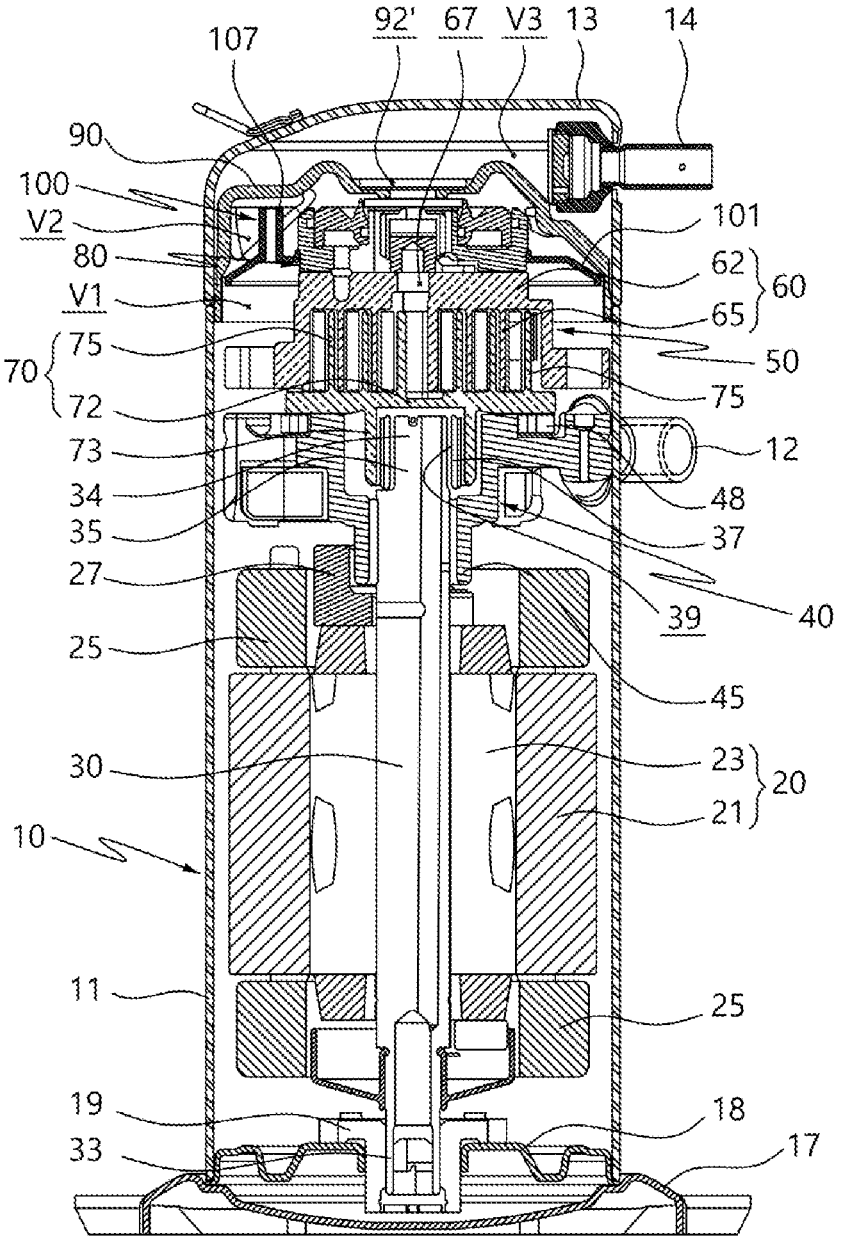
FIG. 1 is a cross-sectional view of a compressor according to an embodiment.

Hereinbelow, embodiments will be described with reference to the accompanying drawings. In adding reference numerals to components of each drawing, it should be noted that the same or like reference numerals are assigned to the same or like components as much as possible even though they are shown in different drawings. In addition, in describing embodiments, descriptions of related known configurations or functions have been omitted.

In addition, in describing components of embodiments, terms such as first, second, A, B, a, and b may be used. These terms are only to distinguish the components from other components, and the nature or order, etc. of the components is not limited by the terms. When a component is described as being "connected", "coupled", or "joined" to other components, that component may be directly connected or joined to the other components, and it will be understood that other components between each component may be "connected", "coupled", or "joined" to each other.

A compressor according to embodiments may include a casing 10; an electric motor 20; a compression device 50; and a rotational shaft 30. A high/low pressure separation plate 90 may be provided at an upper side of the compression device 50, and thus, a path through which refrigerant compressed in the compression device 50 may be discharged to the outside may be provided. Such a structure will be described hereinbelow.

For reference, a scroll compressor, as an example, is described herein; however, the technology disclosed herein may also be applied to a rotary compressor and a swash plate type compressor. That is, the technology disclosed herein may be applied to various compressors having an electric motor (a motor), a rotational shaft 30 rotated by the electric motor, and a compression device in which a volume of a compression chamber is changed by rotation of the rotational shaft 30.

The casing 10 may form an exterior of the compressor, and may have a refrigerant suction space V1 therein. Components for operation of the compressor may be installed in the refrigerant suction space V1. The casing 10 may include a body shell 11 having a cylindrical shape having open upper and lower ends; an upper shell 13 that covers the upper end of the body shell 11; and a lower shell 17 that covers the lower end of the body shell 11. The body shell 11 and the upper shell 13, and the body shell 11 and the lower shell 17 may be fixed to each other by, for example, welding.

The refrigerant suction space V1 may be a space into which refrigerant gas is introduced. The refrigerant gas may be introduced into the refrigerant suction space V1 through a suction tube 12 formed in the body shell 11. The refrigerant suction space V1, which is a low pressure space, may be separated from a refrigerant discharge space V3, which is a high pressure space, by high/low pressure separation plate 90 installed at an upper side of the refrigerant suction space V1. An insulation plate 100 may be installed under the high/low pressure separation plate 90, and an insulation space V2 may be defined between the refrigerant suction space V1 and the refrigerant discharge space V3. Such a structure will be described hereinafter.

The refrigerant suction space V1 may correspond to space located at a lower side of the high/low pressure separation plate 90, and the refrigerant discharge space V3 may correspond to space located at an upper side of the high/low pressure separation plate 90. A discharge tube 14 may be provided in the upper shell 13. The discharge tube 14 may be connected to the refrigerant discharge space V3 and discharge refrigerant to the outside. The discharge tube 14 may be connected to a condenser (not shown) in a refrigeration cycle to transfer refrigerant thereto.

Figure 2:
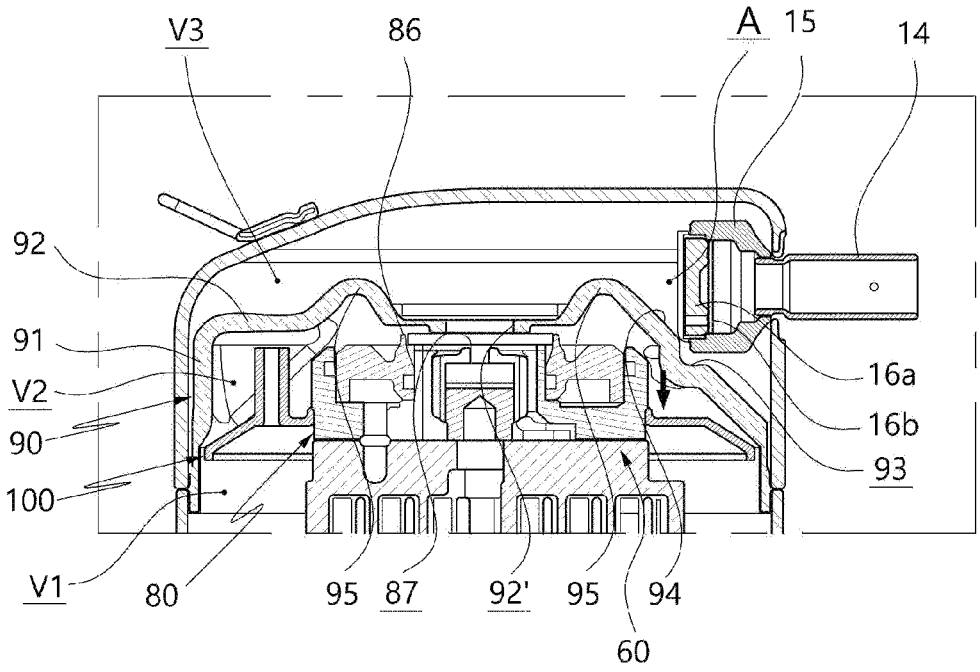
FIG. 2 is a cross-sectional view of an upper portion of the compressor of FIG. 1 including a refrigerant discharge space.

FIG. 1 and FIG. 2 illustrate an embodiment having a check valve 15 connected to the refrigerant discharge space V3. The check valve 15 may be installed at an entrance of the discharge tube 14, and may prevent refrigerant from flowing backward into the refrigerant discharge space V3.

The check valve 15 may be include a valve body 16*a* and a valve plate 16*b*. The valve body 16*a* may be located closer to the refrigerant discharge space V3 than the valve plate 16*b*, and may be fixed. A valve hole (not shown) may be formed through the valve body 16*a* and surround a center of the valve body 16*a* such that refrigerant may pass therethrough. The valve hole may include three valve holes disposed along a circumferential direction of the valve body 16*a*.

The valve plate 16*b* may be installed at the entrance of the discharge tube 14 such that the valve plate 16*b* may move rectilinearly. When the valve plate 16*b* is in close contact with the valve body 16*a*, the valve plate 16*b* may block the valve holes and prevent refrigerant from flowing backward. The valve plate 16*b* may have a shape of a thin plate and have a through hole formed at a center thereof. Accordingly, when the valve plate 16*b* is spaced apart from the valve body 16*a*, the valve plate 16*b* may allow the refrigerant to pass therethrough, but when the valve plate 16*b* is in close contact with the valve body 16*a*, the valve plate 16*b* may block the valve holes.

The electric motor 20 may be provided in the refrigerant suction space V1. The electric motor 20 may generate a rotational force and may rotate the rotational shaft 30. The electric motor 20 may be arranged at a position lower than the compression device 50. Alternatively, the compression device 50 may be arranged at a position lower than the electric motor 20.

The electric motor 20 may include a rotor 21 and a stator 23. The rotor 21 and the stator 23 may be rotate relative to each other. The stator 23 may be fixed to an inner circumferential side of the casing 10, and the rotor 21 may be rotatably installed at an inner side of the stator 23. The stator 23 may include multiple stator cores which are laminated and coils 25 wound on the stator cores. Alternatively, the rotor 21 may include the stator cores and the coils 25 wound on the stator cores.

A balance weight 27 may be provided in the rotor 21. Accordingly, although the rotational shaft 30 has an eccentric portion therein, the rotor 21 may rotate stably.

The stator 23 may be fixed to an inner wall surface of the casing 10 by, for example, a shrinkage fit method, and the rotational shaft 30 may be inserted into a center of the rotor 21. While rotating with the rotor 21, the rotational shaft 30 may function to transmit a rotational force to an orbiting scroll 70 of the compression device 50. The rotational shaft 30 may extend in a vertical direction of the compressor.

A lower end 33 of the rotational shaft 30 may be rotatably supported by a lower bearing 19 mounted to or at the lower end of the casing 10. The lower bearing 19 may be supported by a lower frame 18 fixed to the inner surface of the casing 10, and may stably support the rotational shaft 30. The lower frame 18 may be fixed to the inner surface of the casing 10 by, for example, welding, and a bottom surface of the casing 10 may be used as an oil storage space. Oil stored in the oil storage space may be transferred upward by the rotational shaft 30, and may be introduced to the electric motor 20 and a compression chamber of the compression device 50 to perform lubrication thereof.

An upper end 34 of the rotational shaft 30 may be rotatably supported by a main frame 40. Like the lower frame 18, the main frame 40 may be fixed to the inner surface of the casing 10, and may have an upper bearing 45 provided on a lower surface of the main frame 40 by protruding downward therefrom. The upper end 34 of the rotational shaft 30 may be fitted into the upper bearing 45. The main frame 40 and the upper bearing 45 may be fixed, and as the rotational shaft 30 rotates, the upper end 34 of the rotational shaft 30 and the upper bearing 45 may rotate relative to each other in close contact with each other.

The compression device 50 may function to compress refrigerant while being rotated by the rotational shaft 30 in the refrigerant suction space V1 of the casing 10. The compression device 50 may include two components that rotate relative to each other, that is, a fixed scroll 60 and the orbiting scroll 70. While the orbiting scroll 70 rotates in engagement with an eccentric protrusion 35 that protrudes from the upper end 34 of the rotational shaft 30, the orbiting scroll 70 may change a volume of a compression chamber between the orbiting scroll 70 and the fixed scroll 60. In this process, refrigerant present in the compression chamber may be compressed and discharged.

A coupling structure between the compression device 50 and the rotational shaft 30 will be described hereinafter. A coupling portion 73 may be provided on a lower surface of an orbiting plate 72 of the orbiting scroll 70, and a coupling space may be defined inside of the coupling portion 73. A sliding bushing 37 may be fitted into the coupling space, and the eccentric protrusion 35 of the rotational shaft 30 may be fitted into the sliding bushing 37.

The sliding bushing 37 may move relative to the eccentric protrusion 35 of the rotational shaft 30 while sliding along a rectilinear path, but may move relative to the orbiting scroll 70 while sliding along a circumferential direction thereof. The sliding bushing 37 may have a substantially cylindrical shape, and may have sliding space 39 formed vertically through a center thereof. The eccentric protrusion 35 may be fitted into the sliding space 39, and the sliding bushing 37 and the eccentric protrusion 35 may not rotate relative to each other.

The fixed scroll 60 and the orbiting scroll 70 may rotate in contact with each other, and more precisely, the orbiting scroll 70 may change the volume of the compression chamber while orbiting without rotating. The fixed scroll 60 may include a fixed plate 62 formed on an upper portion thereof, the fixed plate 62 having a shape of a disk, and a fixed wrap 65 that protrudes downward from the fixed plate 62. The fixed wrap 65 may have a spiral shape to interlock with an orbiting wrap 75 of the orbiting scroll 70 described hereinafter. The fixed wrap 65 may have an introduction hole formed in a side surface thereof such that refrigerant present in the refrigerant suction space V1 may be introduced therethrough. Further, a discharge hole 67 may be formed in or at a center of the fixed scroll 60 such that compressed refrigerant may be discharged therethrough.

The orbiting scroll 70 may include the orbiting plate 72 having a substantially disk shape, and the spiral orbiting wrap 75 that protrudes from the orbiting plate 72 in a direction toward the fixed plate 62. The orbiting wrap 75 and the fixed wrap 65 may form the compression chamber in cooperation with each other.

The orbiting plate 72 of the orbiting scroll 70 may orbit with the orbiting plate 72 being supported by an upper surface of the main frame 40. An Oldham ring 48 may be installed between the orbiting plate 72 and the main frame 40 and may prevent the orbiting scroll 70 from rotating. Further, the coupling portion 73 having a substantially ring shape may protrude from a lower surface of the orbiting plate 72 of the orbiting scroll 70. The eccentric protrusion 35 of the rotational shaft 30 may be inserted into the coupling portion 73. Accordingly, a rotational force of the rotational shaft 30 may allow the orbiting scroll 70 to orbit. More precisely, the sliding bushing 37 may be located between the eccentric protrusion 35 and the coupling portion 73.

A backpressure assembly 80 may be mounted to the upper portion of the compression device 50. The backpressure assembly 80 may be mounted at an upper side of the fixed plate 62 of the fixed scroll 60, and may have a body having a substantially ring shape which forms a frame of the backpressure assembly, and may be in contact with the fixed scroll 60.

Figure 3:
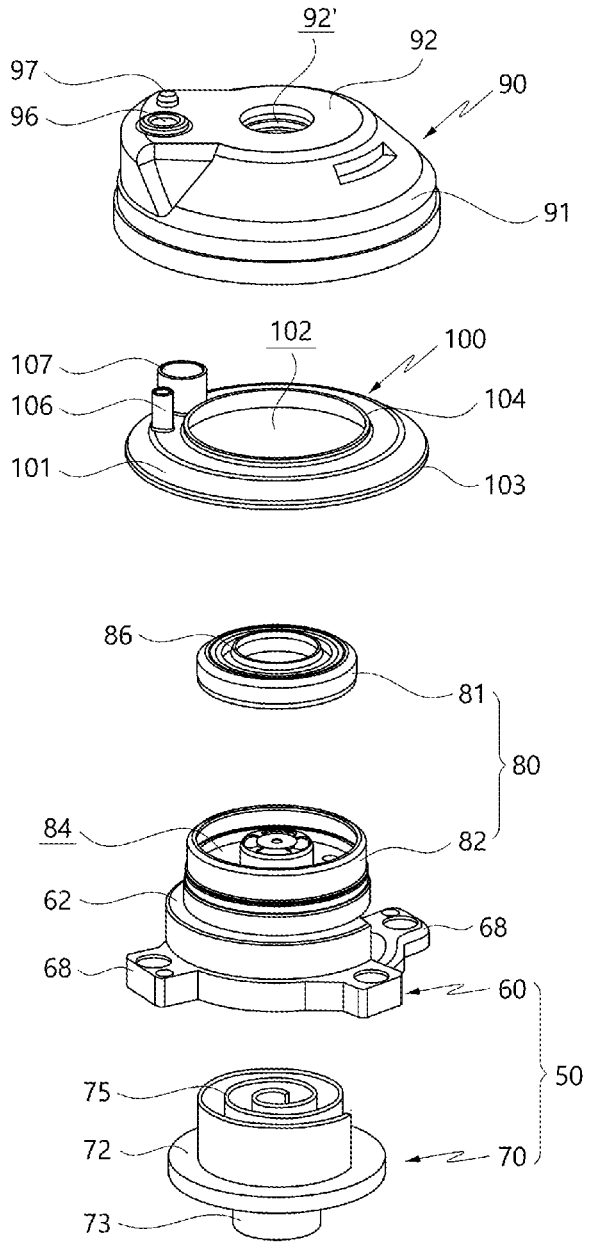
FIG. 3 is an exploded perspective view of the upper structure of FIG. 2.
Figure 4:
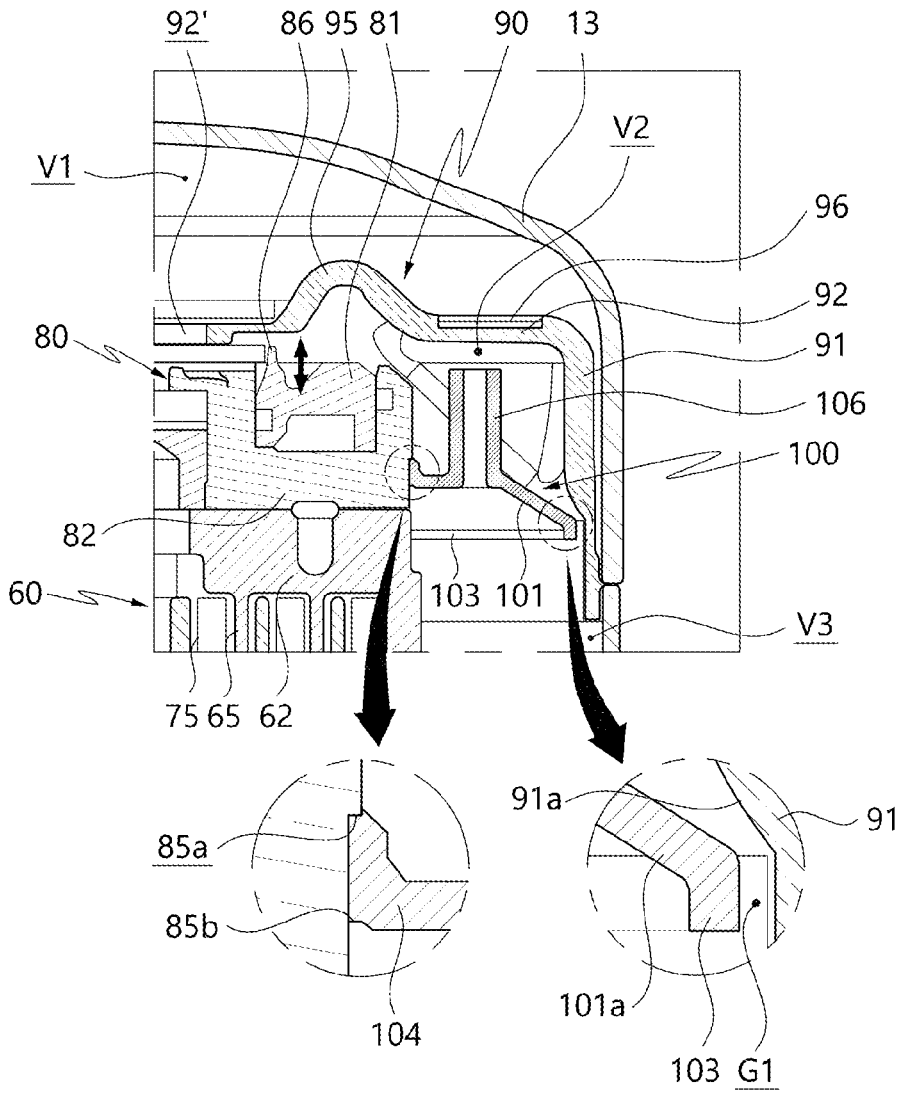
FIG. 4 is a cross-sectional view illustrating enlarged main components relative to an insulation plate in FIG. 2.
Figure 5:
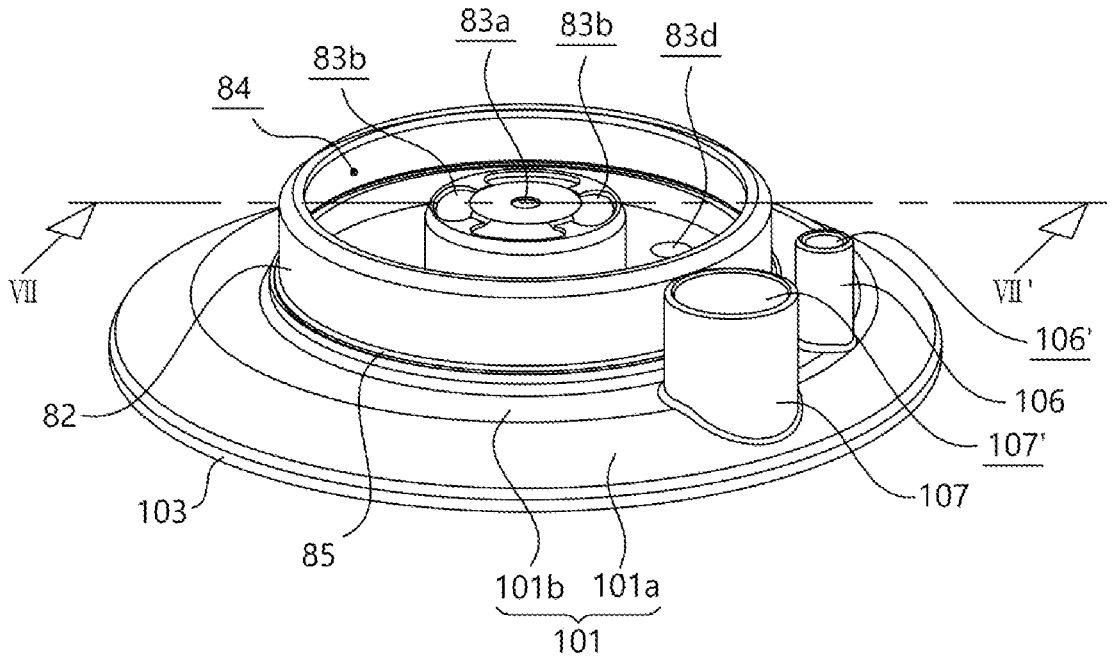
FIG. 5 is a perspective view of a backpressure assembly and the insulation plate of the compressor according to an embodiment.

Referring to FIGS. 2 to 4, the backpressure assembly 80 may include a backpressure plate 82 coupled to the upper portion of the fixed scroll 60, and a backpressure piston 81 that moves up and down vertically relative to the backpressure plate 82. During compression by the compression device 50, the backpressure piston 81 may rise and may function to separate the low pressure portion located at an inner side of the backpressure assembly 80 from the high pressure portion located at an outer side of the backpressure assembly 80. Reference numeral 87 refers to a backpressure hole connected to the discharge hole 67 of the fixed scroll 60, and the backpressure hole 87 may be connected to the refrigerant discharge space V3 through a communication hole 92' of the high/low pressure separation plate 90.

Operation of such a backpressure assembly 80 will be described hereinafter. When the compression chamber of the compression device 50 communicates with a backpressure hole (not shown) of the fixed scroll 60, a portion of the refrigerant gas flowing through the compression chamber of the compression device 50 may be introduced to an intermediate pressure flow path 83*c* of the backpressure plate 82 before reaching the discharge hole 67. Accordingly, intermediate pressure may be applied to a backpressure chamber 84 defined by the backpressure plate 82 and the backpressure piston 81. Accordingly, the backpressure plate 82 may be pressurized downward, and the backpressure piston 81 may be pressurized upward.

As the backpressure plate 82 is coupled to the fixed scroll 60 by a bolt, the intermediate pressure of the backpressure chamber 84 may also affect the fixed scroll 60. However, the fixed scroll 60 may already be in contact with the orbiting scroll 70 and may not be moved downward, so the backpressure piston 81 may be moved upward. When a sealing end 86 is in contact with the lower end of the high/low pressure separation plate 90, the backpressure piston 81 may prevent refrigerant gas leaking from the refrigerant discharge space V3 to the refrigerant suction space V1. In addition, the pressure of the backpressure chamber 84 may push the fixed scroll 60 to the orbiting scroll 70 and may prevent leakage of refrigerant gas between the fixed scroll 60 and the orbiting scroll 70.

Referring to FIGS. 5 to 8, multiple holes may be formed through the backpressure plate 82. The backpressure plate 82 may have a valve hole 83*a* formed in a center thereof so as to open and close the check valve (not shown), and multiple backpressure refrigerant holes 83*b* may be formed surrounding the valve hole 83*a*. Each of the back chamber refrigerant holes 83*b* may be a hole through which refrigerant compressed in the compression device 50 may be transferred to the refrigerant discharge space V3.

The intermediate pressure flow path 83*c* may be formed in the backpressure plate 82, and may be connected to the backpressure chamber 84. That is, when the refrigerant gas flows upward through the intermediate pressure flow path 83*c*, the backpressure piston 81 sitting in the backpressure chamber 84 may be moved upward. The intermediate pressure flow path 83*c* may include multiple intermediate pressure flow paths formed in the backpressure chamber 84.

In addition, fastening holes 83*d* may be formed in a bottom of the backpressure chamber 84 of the backpressure plate 82, and may be fastening holes for assembling the backpressure plate 82 with the fixed scroll 60. Bolts may be fastened to the fastening holes 83*d*.

The backpressure plate 82 may have a holding step 85 at a side surface thereof. The holding step 85 may be formed on the side surface of the backpressure plate 82, and may have a structure recessed from an outer circumferential surface of the backpressure plate 82 surrounding the outer circumferential surface thereof, or may be a step formed on a portion of the backpressure plate 82 having a different diameter. A second connection end 104 of the insulation plate 100 described hereinafter may be held in and fixed to the holding step 85.

The high/low pressure separation plate 90 may be located at an upper side of the backpressure assembly 80. The high/low pressure separation plate 90 may separate the refrigerant suction space V1, which is the low pressure space, from the refrigerant discharge space V3, which is the high pressure space, and may be installed to extend across an upper side of the compression device 50. The high/low pressure separation plate 90 may be a substantially thin plate shape, and the refrigerant discharge space V3 may be located on or at the upper surface of the high/low pressure separation plate 90, so that the high/low pressure separation plate 90 may be greatly pressurized downward. Accordingly, it is important that the high/low pressure separation plate 90 is not deformed by high pressure.

A structure of the high/low pressure separation plate 90 is illustrated in FIG. 2. As illustrated in FIGS. 2 and 3, a separation body 91 may form a frame of the high/low pressure separation plate 90. The separation body 91 may have a shape having a width gradually decreasing in an upward direction, and upper surface 92 may have a planar structure. The communication hole 92' may be formed in or at a center of the upper surface 92. The communication hole 92' may be connected to the discharge hole 67 of the fixed scroll 60 and the backpressure hole 87 of the backpressure assembly 80 which are described above.

A groove 93 may be formed in a side of the separation body 91, and may have a shape recessed inward. The groove 93 may be located under the check valve 15, and may prevent the separation body 91 from interfering with the check valve 15. Referring to FIG. 2, a lower portion of the check valve 15 may be located in the groove 93. An inclined surface 94 may be provided at the upper side of the groove 93, and may function to induce flow of refrigerant toward the check valve 15.

Protection means 96 and 97 may be provided on the upper surface 92 of the separation body 91. When the refrigerant discharge space V3 is excessively high in temperature or pressure, the protection means 96 and 97 may function to relieve high temperature or pressure, and may include a pressure control valve 97 and an overheat prevention unit 96.

The pressure control valve 97 may be opened when the refrigerant discharge space V3 reaches at least a predetermined pressure, and may be regarded as a kind of bypass structure which functions to decrease the pressure of the refrigerant discharge space V3. More precisely, the pressure control valve 97, for example, an injection pressure regulator: IPR, having a hole that communicates with the refrigerant suction space V1 and including a spring and a ball installed in the hole may be installed at a side of the refrigerant discharge space V3. When the inner pressure of the refrigerant discharge space V3 is greater by at least a predetermined amount than the pressure of the refrigerant suction space V1, the pressure control valve 97 may allow refrigerant to be discharged to the refrigerant suction space V1. Accordingly, when the inner pressure of the refrigerant discharge space V3 increases excessively, the pressure of the backpressure chamber may be decreased by the pressure control valve 97.

In addition, the overheat prevention unit 96 may be opened when the refrigerant discharge space V3 reaches at least a predetermined temperature, and may function to decrease the temperature of the refrigerant discharge space V3. The overheat prevention unit 96 may be configured as a bimetal according to one embodiment. When the temperature of the refrigerant discharge space V3 reaches at least the predetermined temperature, the overheat prevention unit 96 may provide communication between the refrigerant discharge space V3 and the refrigerant suction space V1 such that the refrigerant gas of the refrigerant discharge space V3 leaks to the refrigerant suction space V1. The leaking refrigerant gas having a high temperature may allow an overload breaker (not shown) provided on an upper end of the stator 23 to operate and stop the compressor. Accordingly, the overheat prevention unit 96 may sensitively respond to the temperature of the refrigerant discharge space V3. Alternatively, such protection means 96 and 97 may be omitted.

The insulation plate 100 may be installed in the casing 10. The insulation plate 100 may block the high/low pressure separation plate 90 and the suction tube 12 from each other by being located therebetween, such that the insulation space V2 may be defined between the insulation plate 100 and the high/low pressure separation plate 90. The insulation space V2 may be regarded as an intermediate area located between the refrigerant suction space V1 and the refrigerant discharge space V3. The insulation space V2 may prevent the high temperature of the refrigerant discharge space V3 from being transferred directly to the refrigerant suction space V1.

The first end of the insulation plate 100 may be connected to the compression device 50 or the backpressure assembly 80 located at a center of the insulation plate 100, and the second end of the insulation plate 100 may extend toward the inner surface of the casing 10. A connection hole 102 may be formed in the center of the insulation plate 100, and thus, the compression device 50 or the backpressure assembly 80 may be fitted to a center of the connection hole 102.

Figure 9:
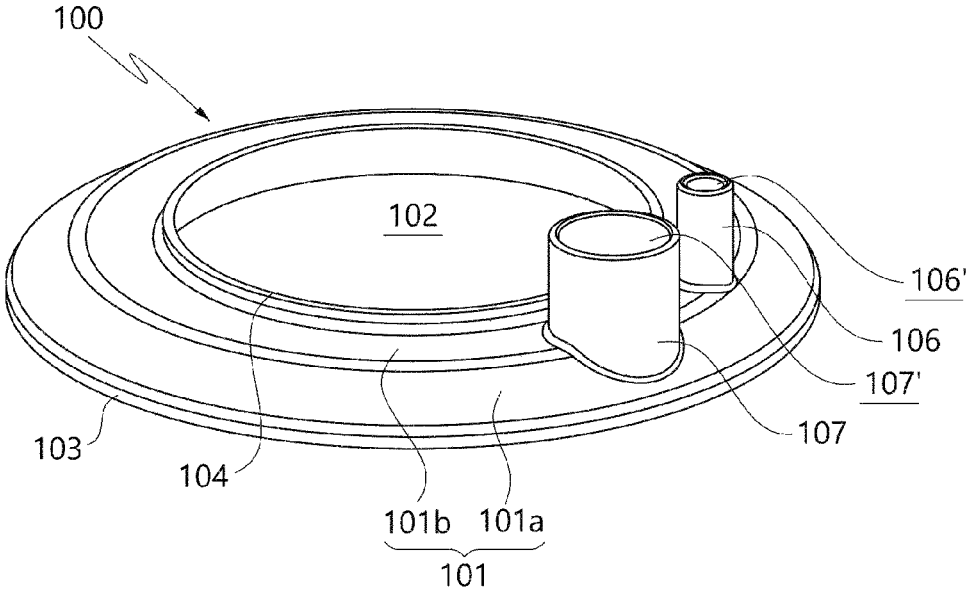
FIG. 9 is a perspective view of the insulation plate according to an embodiment.

Referring to FIG. 9, a circular insulation body 101 having the connection hole 102 formed through a center thereof may form a frame of the insulation plate 100. The insulation body 101 may be configured to have a shape of a substantially ring-shaped thin plate. A first connection end 103 and the second connection end 104 may be provided at opposite sides of the insulation body 101 along a radial direction thereof. The first connection end 103 may be provided along an outer edge of the insulation body 101, and may face the inner surface of the casing 10.

The insulation body 101 of the insulation plate 100 may have a circular shape forming a closed curve surrounding the compression device 50 or the backpressure assembly 80. However, the insulation body 101 may not be required to form the closed curve, and may have a shape having a portion cut out from the closed curve. Alternatively, the insulation body 101 may be composed of multiple pieces. For example, two insulation bodies 101 having semicircular shapes may be assembled with each other to form one ring shape.

The second connection end 104 may have a diameter smaller than a diameter of the first connection end 103, and may be provided along an edge of the connection hole 102 of the insulation body 101. The second connection end 104 may be connected to an outer surface of the compression device 50 or of the backpressure assembly 80. That is, in this embodiment, the second connection end 104 may allow the insulation plate 100 to be fixed to an inside of the compressor. Of course, each of the first connection end 103 and the second connection end 104 may be fixed to the inside of the compressor, or only the first connection end 103 may be fixed to the inner surface of the casing 10.

Accordingly, the insulation plate 100 may be configured to have a simple structure having a plate shape blocking a high temperature portion (refrigerant discharge space) and a low temperature portion (refrigerant suction space) from each other by being located therebetween, whereby suction volume efficiency may be improved without complicating the internal structure of the compressor. More particularly, the insulation plate 100 may be fitted over an outer circumferential surface of the compression device 50 or of the backpressure assembly 80, and may be applied to an existing compressor without changing the design thereof.

Figure 7:
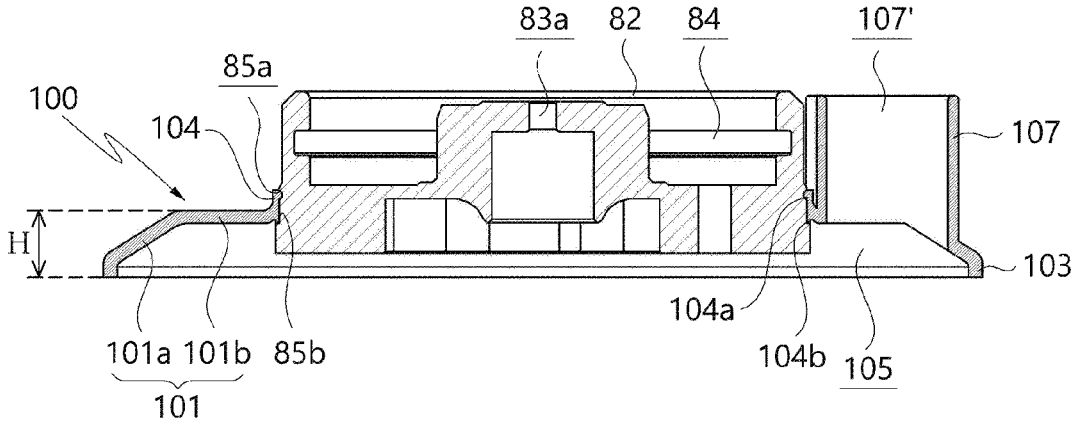
FIG. 7 is a cross-sectional view, taken along line VII-VII' of FIG. 5.
Figure 8:
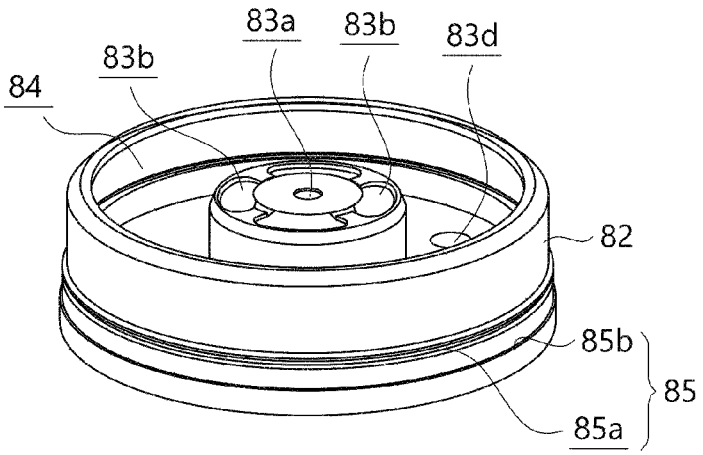
FIG. 8 is a perspective view of the backpressure assembly according to an embodiment.

Referring to FIG. 7, the first connection end 103 may be located at a position lower than the second connection end 104 along an axial direction (a vertical direction relative to the drawing) of the rotational shaft 30. More precisely, there may be a height difference H between the first connection end 103 and the second connection end 104.

The height difference between the first connection end 103 and the second connection end 104 is intended to correspond to a shape of the high/low pressure separation plate 90. That is, an outer edge of the high/low pressure separation plate 90 may be located at a position lower than an inner edge thereof, and thus, the high/low pressure separation plate 90 may have an inclined structure, so that the insulation plate 100 may be inclined downward from the second connection end 104 toward the first connection end 103. When the insulation plate 100 is formed to incline downward from the second connection end 104 toward the first connection end 103, the insulation plate 100 may be arranged closer to the high/low pressure separation plate 90, which may minimize a decrease in volume of the refrigerant suction space V1 located under the insulation plate 100 due to the presence of the insulation plate 100.

In this embodiment, a predetermined space G1 may be defined between the first connection end 103 of the insulation plate 100 and the inner surface of the casing 10. That is, the first connection end 103 may be spaced apart by a predetermined space G1 from the casing 10. Referring to FIG. 4, the space G1 is present between the first connection end 103 and the inner surface of the casing 10.

The space G1 may prevent the insulation space V2 defined between the insulation plate 100 and the high/low pressure separation plate 90 from being vacuumized. When a vacuum is formed between the insulation plate 100 and the high/low pressure separation plate 90, the backpressure piston 81 having risen and moved into contact with the lower end of the high/low pressure separation plate 90 may not move downward. However, in this embodiment, the space G1 may prevent such a vacuum from being formed.

In addition, the space G1 may prevent the insulation plate 100 from being damaged in the process of manufacturing the casing 10. For example, the casing 10 may be formed by welding the upper shell 13 to the body shell 11 having a cylindrical shape. In the welding process, the first connection end 103 of the insulation plate 100 arranged close to a welding portion may be melted by welding heat. However, in this embodiment, the predetermined space G1 may be defined between the first connection end 103 and the inner surface of the casing 10, so that the welding heat may be prevented from being transferred directly to the first connection end 103.

As illustrated in FIG. 4, a portion of an end of the first connection end 103 may extend vertically to face the inner surface of the casing 10. The end portion extending vertically from the first connection end 103 may improve assemblage of the insulation plate 100 when the insulation plate 100 is lowered and assembled inside of the casing 10, and may prevent a sharp end of the first connection end 103 from being abraded while rubbing against the inner surface of the casing 10.

At least a portion of the second connection end 104 may extend toward the high/low pressure separation plate 90 along the axial direction of the rotational shaft 30 so as to be in surface contact with the outer circumferential surface of the compression device 50 or of the backpressure assembly 80. Referring to FIG. 4, the end of the second connection end 104 is in surface contact with the outer surface of the backpressure assembly 80.

In this case, the backpressure assembly 80 may have the holding step 85 on the outer circumferential surface thereof. The holding step 85 may include an upper step 85*a* and a lower step 85*b*, and may be recessed between the upper step 85*a* and the lower step 85*b*. The end of the second connection end 104 may be held between the upper step 85*a* and the lower step 85*b*. Of course, a structure in which the second connection end 104 is held in the outer circumferential surface of the backpressure assembly 80 may be variously modified. For example, only the lower step 85*b* may be provided on the outer circumferential surface of the backpressure assembly 80, and the end of the second connection end 104 may be held in the lower step 85*b*. Alternatively, the end of the second connection end 104 may be fixed to the outer circumferential surface of the backpressure assembly 80 by adhesive or a separate fastener, for example.

Referring to FIG. 7, an upper holding part or holder 104*a* may be provided on the upper end of the end of the second connection end 104, and a lower holding part or holder 104*b* may be provided on the lower end thereof. The upper holder 104*a* may be held in the upper step 85*a* of the upper end of the holding step 85, and the lower holder 104*b* may be held in the lower step 85*b*.

The insulation body 101 of the insulation plate 100 may include a flat surface portion 101*b* and an inclined portion 101*a*. The flat surface portion 101*b* may extend in a direction orthogonal to the axial direction of the rotational shaft 30, and the inclined portion 101*a* may extend at an incline from the flat surface portion 101*b*. The first end of the flat surface portion 101*b* may be the second connection end 104, and the first end of the inclined portion 101*a* may be the first connection end 103. Accordingly, the insulation body 101 may include at least two portions different from each other in angles relative to the axial direction of the rotational shaft 30. Of course, alternatively, the insulation body 101 may include at least three portions different from each other in angles relative to the axial direction.

The insulation body 101 may not be a simple planar structure, but may include the flat surface portion 101*b* and the inclined portion 101*a*, so pressure resistance of the insulation body 101 may be increased. For example, the insulation body 101 may be prevented from being bent by the inner pressure of the refrigerant suction space V1 or by vibration transmitted during operation of the compressor.

Figure 6:
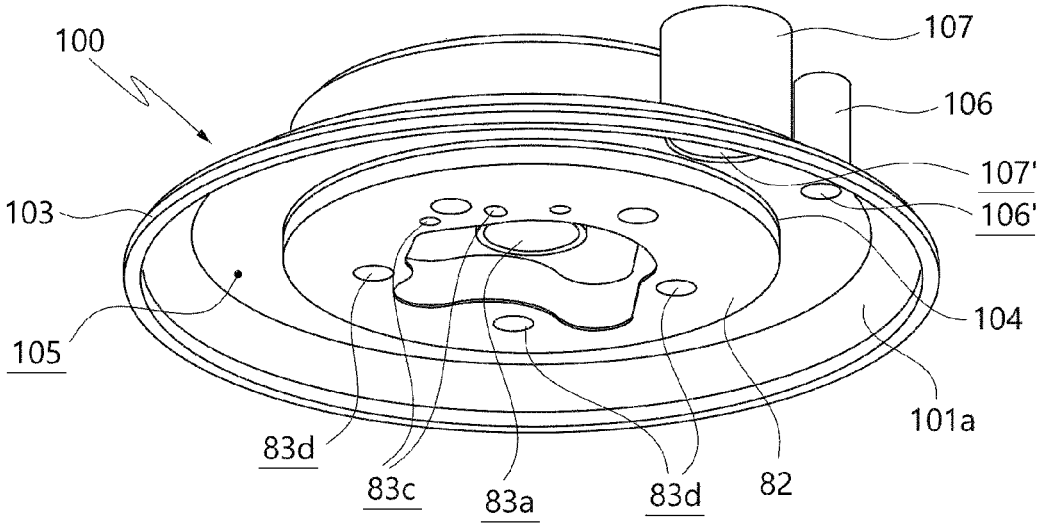
FIG. 6 is a perspective view of the backpressure assembly and the insulation plate of FIG. 5 from below.

Accordingly, the insulation body 101 may include the flat surface portion 101*b* and the inclined portion 101*a*, and thus, a predetermined empty space 105 which is concavely recessed may be formed under the insulation plate 100 as illustrated in FIGS. 6 and 7. The empty space 105 may form a portion of the refrigerant suction space V1 located at a lower side thereof.

The connection guide may protrude from the insulation plate 100 toward at least one of the overheat prevention unit 96 or the pressure control valve 97 both provided on the high/low pressure separation plate 90. The connection guide may function to connect the overheat prevention unit 96 or the pressure control valve 97 to the refrigerant suction space V1, and may have a structure of a kind of a tube. In this embodiment, the connection guide may include two connection guides, that is, first connection guide 106 that extends toward the overheat prevention unit 96 and second connection guide 107 that extends toward the pressure control valve 97. Reference numeral 106' refers to a connection space inside of the first connection guide 106, and reference numeral 107' refers to connection space inside of the second connection guide 107.

As illustrated in FIGS. 2 and 4, the first connection guide 106 and the second connection guide 107 may extend toward the overheat prevention unit 96 and the pressure control valve 97, respectively, and may not be in close contact with the overheat prevention unit 96 and the pressure control valve 97. This is because when the first connection guide 106 and the second connection guide 107 touch the overheat prevention unit 96 and the pressure control valve 97, the first connection guide 106 or the second connection guide 107 may be damaged by vibration occurring during operation of the compressor.

Although not shown, a guide may be provided in the insulation plate 100, the guide being fixed to the compression device 50 or the backpressure assembly 80 and preventing rotation of the insulation plate 10. The guide may protrude from the second connection end 104 and be fixed to the compression device 50 or the backpressure assembly 80, and thus, may prevent rotation of the insulation plate 100. That is, the guide may be regarded as a kind of stopper.

Figure 10:
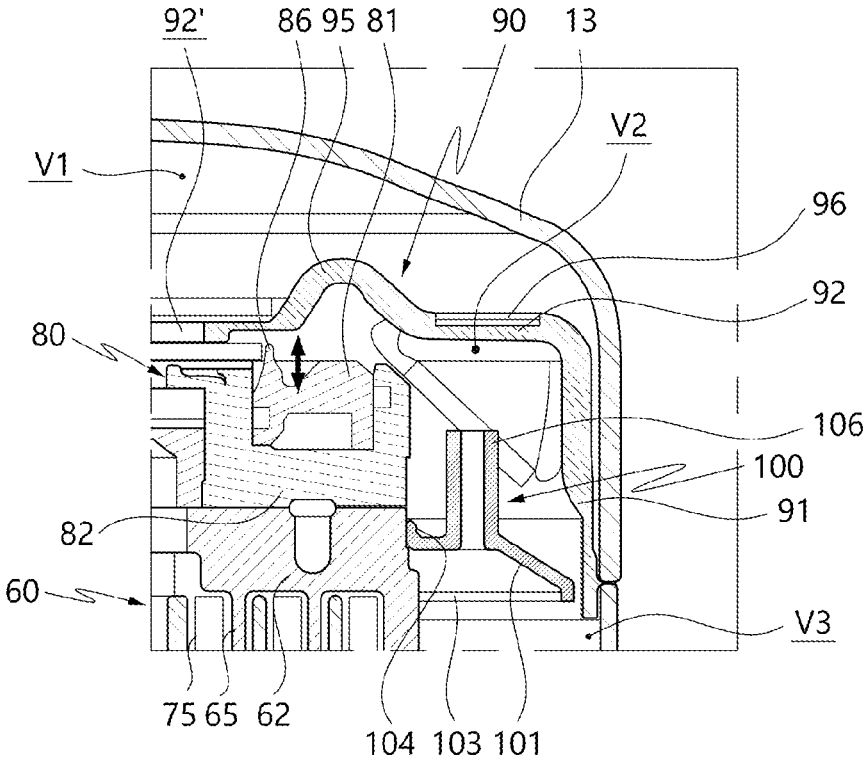
FIG. 10 is a cross-sectional view illustrating a state in which the insulation plate is coupled to a compression device according to an embodiment.

Referring to FIG. 10, unlike the embodiment illustrated in FIG. 2, the insulation plate 100 may be fixed to the compression device 50 instead of the backpressure assembly 80. More precisely, the insulation plate 100 may be fitted over an outer circumferential surface of the fixed scroll 60 of the compression device 50. The fixed scroll 60, like the backpressure assembly 80, may be fixed and may not rotate, so the insulation plate 100 may be coupled to the outer circumferential surface of the fixed scroll 60.

Figure 11:
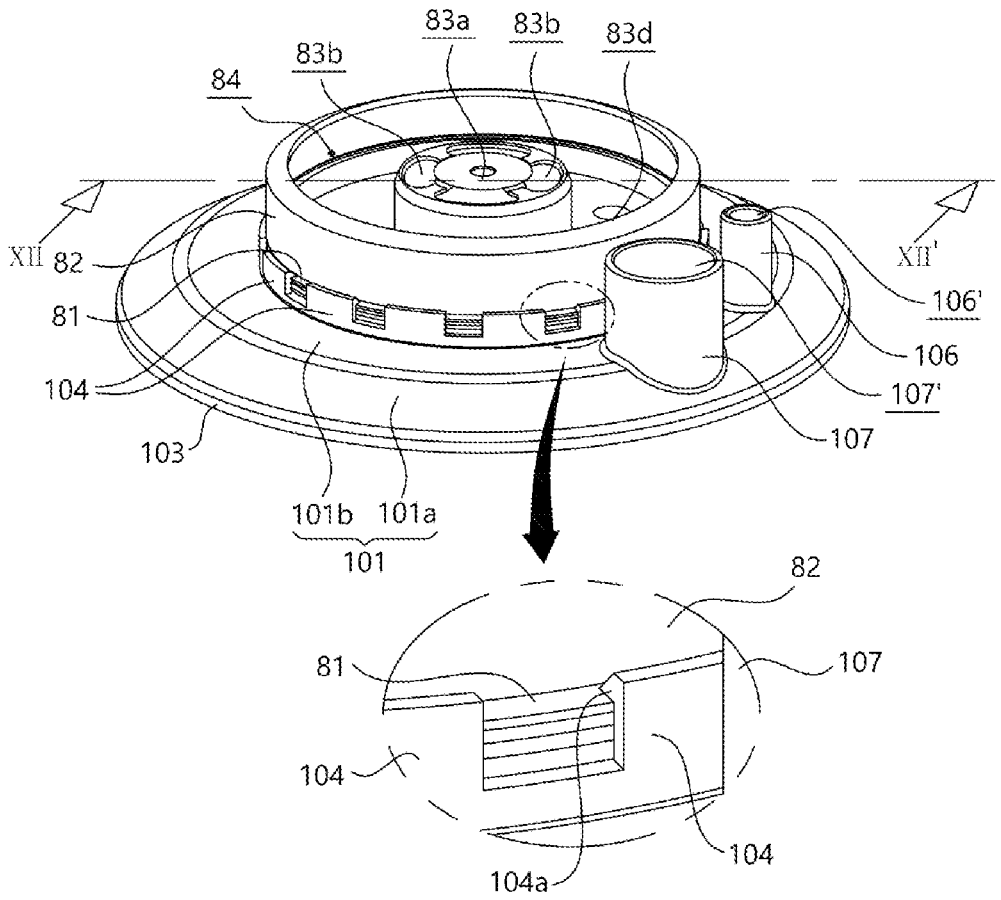
FIG. 11 is a perspective view illustrating a state in which an insulation plate is coupled to a backpressure assembly according to another embodiment.
Figure 12:
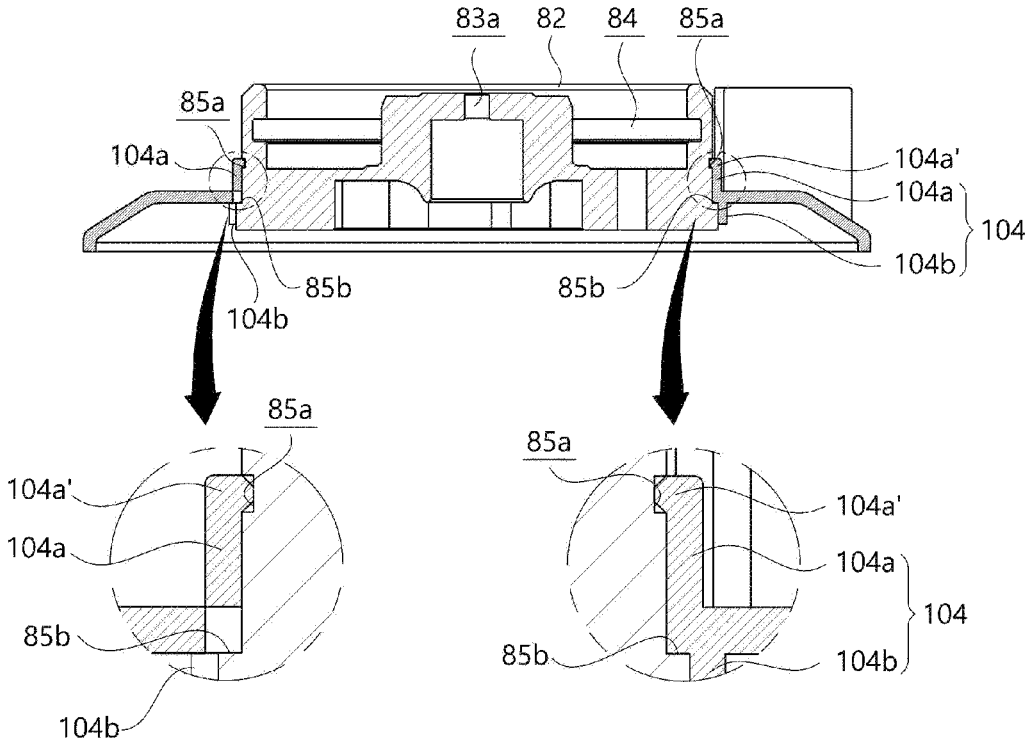
FIG. 12 is a cross-sectional view, taken along line XII-XII' of FIG. 11.

FIGS. 11 and 12 illustrate another embodiment of the insulation plate 100. Description of the same components as components of the insulation plate 100 described above have been omitted.

As illustrated in FIG. 11, a holding hook 104*a*' may be formed on second connection end 104 of insulation plate 100, the holding hook 104*a*' being elastically transformed in a direction away from the compression device 50 or the backpressure assembly 80. The holding hook 104*a*' may have a cantilever structure, and in upper holder 104*a* of the second connection end 104, may extend parallel to the outer circumferential surface of the compression device 50 or of the backpressure assembly 80. Accordingly, when the insulation plate 100 is fitted over the compression device 50 or the backpressure assembly 80 from the upper side thereof toward the lower side thereof, the holding hook 104*a*' may be elastically transformed to be opened, and may be restored to an initial shape thereof.

As a result, the holding hook 104*a*' may be held in and fixed to upper step 85*a* provided on the outer circumferential surface of the compression device 50 or of the backpressure assembly 80. The holding hook 104*a*' may include multiple holding hooks formed along a circumferential direction of the second connection end 104. That is, the multiple holding hooks 104*a*' may be elastically transformed independently. Accordingly, although a center of the insulation plate 100 is slightly biased during assembly of the insulation plate 100, the holding hook 104*a*' may be assembled with the compression device 50 or the backpressure assembly 80 while being elastically transformed.

Referring to FIG. 12, the lower holder 104*b* may be formed on the second connection end 104, the lower holder 104*b* extending by being stepped in a direction opposite to the holding hook 104*a*'. The lower holder 104*b* may be held in the lower step 85*b* formed in the outer circumferential surface of the compression device 50 or of the backpressure assembly 80. Accordingly, the holding hook 104*a*' may be held in the upper step 85*a*, and at the same time, the lower holder 104*b* may be held in the lower step 85*b* such that the second connection end 104 is held in two positions. The lower holder 104*b* may have a stepped shape.

Figure 13:
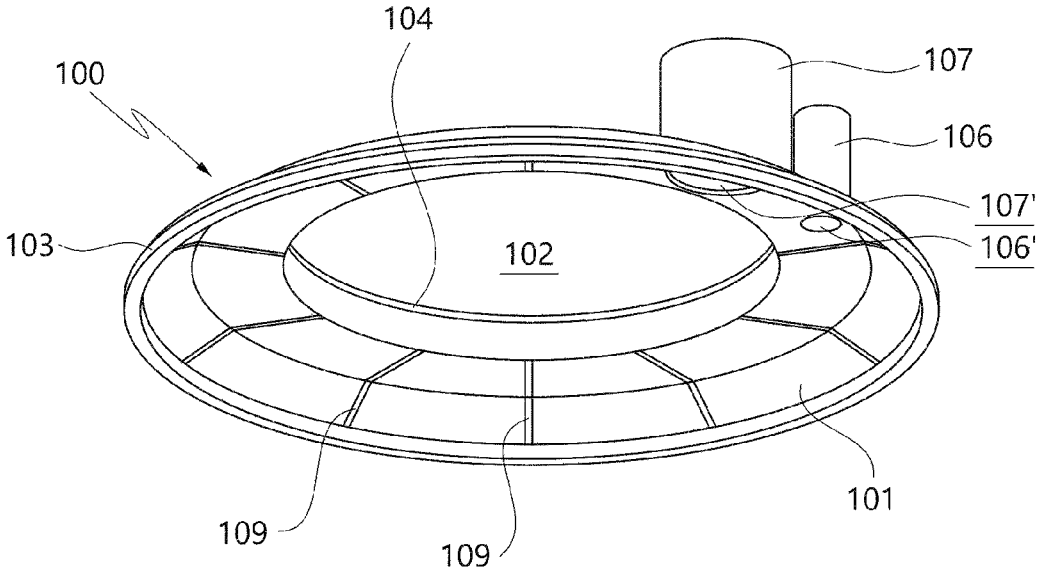
FIG. 13 is a perspective view of an insulation plate according to still another embodiment.

Referring to FIG. 13 illustrating another embodiment of the insulation plate, a reinforcing rib 109 may be provided on the insulation plate 100 in a direction connecting the first connection end 103 and the second connection end 104 of the insulation plate 100 to each other. The reinforcing rib 109 may protrude from the lower surface of the insulation body 101 and extend in a radial direction of the insulation plate 100.

The reinforcing rib 109 may include multiple reinforcing ribs arranged spaced apart from each other on the lower surface of the insulation body 101, and the reinforcing ribs may extend radially. Such reinforcing ribs 109 may reinforce a rigidity of the insulation body 101 of the insulation plate 100, and may prevent the insulation plate 100 from bending due to an external force or temperature. Of course, the reinforcing rib 109 may protrude from the upper surface of the insulation body 101.

Figure 14:
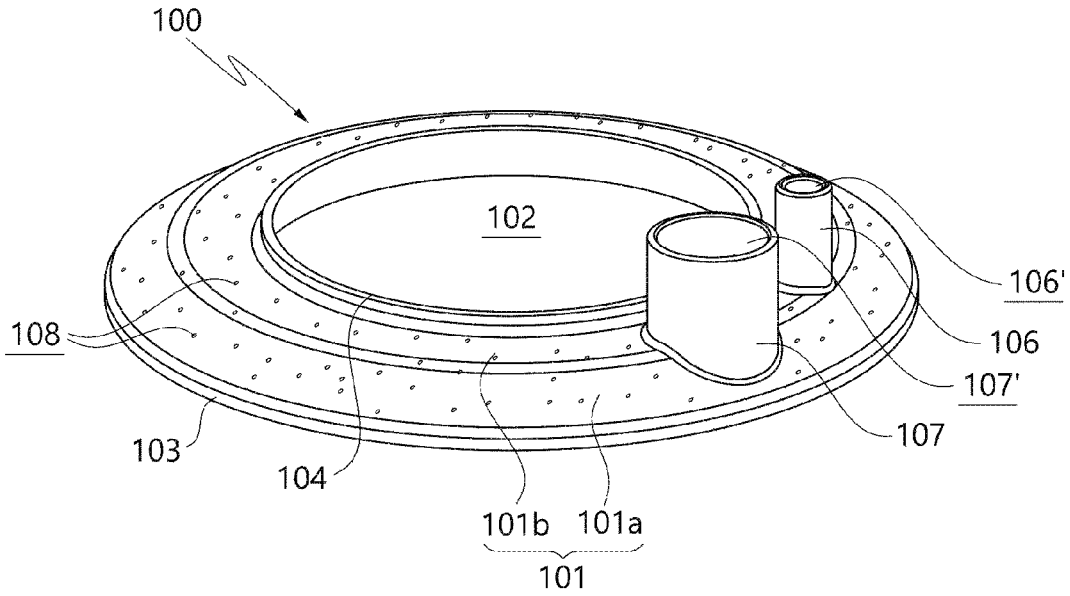
FIG. 14 is a perspective view of an insulation plate according to still another embodiment.

FIG. 14 illustrates still another embodiment of the insulation plate 100. As illustrated in FIG. 14, multiple through holes 108 may be formed in the insulation plate 100. Each of the through holes 108 may be formed through the insulation body 101 of the insulation plate 100. The through hole 108 may communicate the insulation space V2 with the refrigerant suction space V1 located under the insulation plate 100. The multiple through holes 108 may include multiple through holes formed at uniform or non-uniform intervals in the entire section of the insulation body 101.

The multiple through holes 108 may prevent the insulation space V2 defined between the insulation plate 100 and the high/low pressure separation plate 90 from being vacuumized. If a vacuum is formed between the insulation plate 100 and the high/low pressure separation plate 90, the backpressure piston 81 having risen and in contact with the lower end of the high/low pressure separation plate 90 may not move downward again. In this embodiment, the multiple through holes 108 may prevent such a vacuum from forming.

Figure 15:
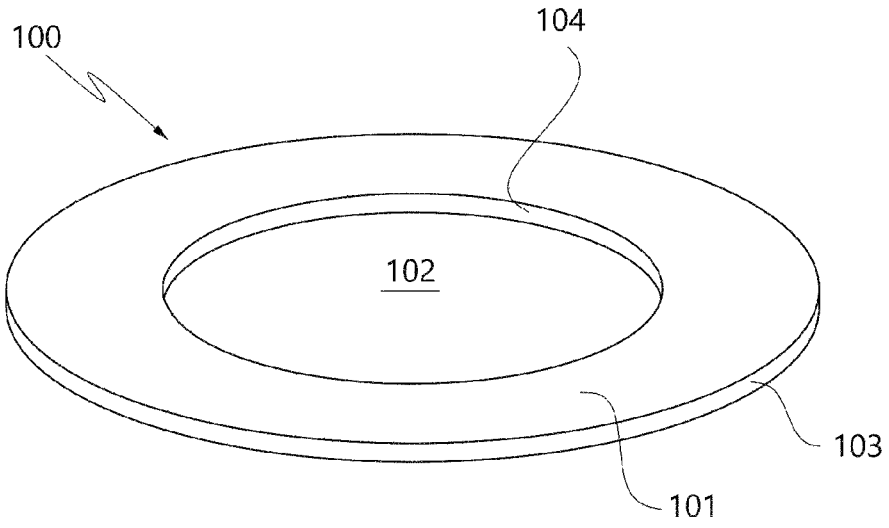
FIG. 15 is a perspective view of an insulation plate according to still another embodiment.

As illustrated in FIG. 15, the insulation body 101 of the insulation plate 100 may be a flat plate. That is, the insulation body 101 may not include the flat surface portion 101*b* and the inclined portion 101*a*, but may have a predetermined height in a direction orthogonal to the axial direction of the rotational shaft 30.

Figure 16:
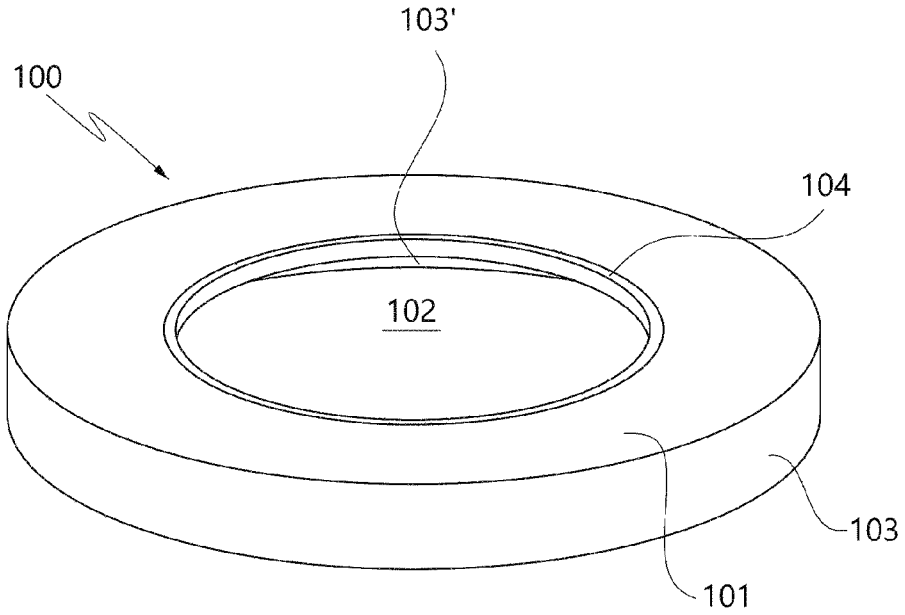
FIG. 16 is a perspective view of an insulation plate according to still another embodiment.

In still another embodiment illustrated in FIG. 16, the insulation body 101 of the insulation plate 100 is a flat plate. However, the first connection end 103 may be formed on the outer edge of the insulation plate 100. The first connection end 103 may extend vertically so as to face the inner circumferential surface of the casing 10. In this case, a gap between the outer surface of the first connection end 103 and the inner circumferential surface of the casing 10 may be decreased and a heat transfer path may be narrower, so blocking of heat transfer may be increased.

Figure 17:
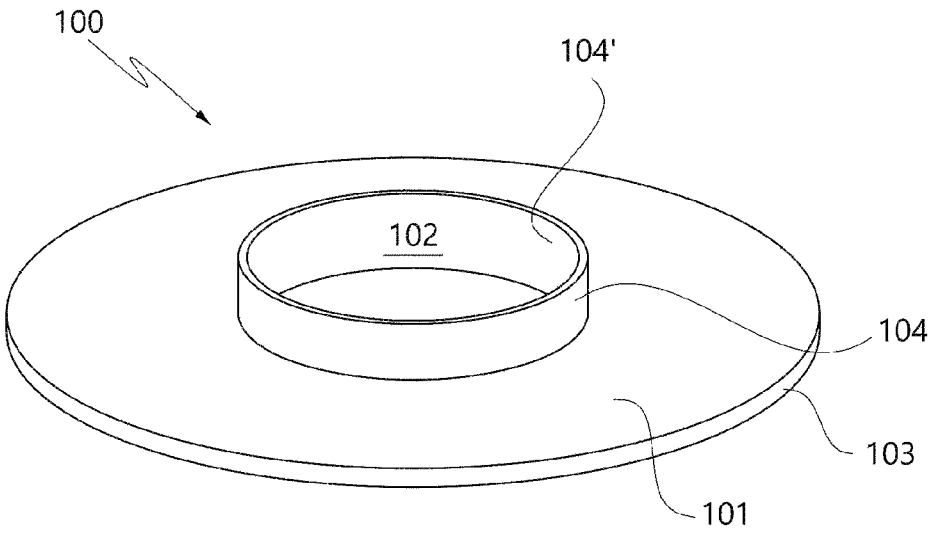
FIG. 17 is a perspective view of an insulation plate according to still another embodiment.

In still another embodiment illustrated in FIG. 17, the insulation body 101 of the insulation plate 100 is a flat plate. However, the second connection end 104 may be provided on the inner edge of the insulation plate 100, and may extend vertically so as to face the outer circumferential surface of the backpressure assembly 80. Accordingly, a contact area between the second connection end 104 and the outer circumferential surface of the backpressure assembly 80 may be increased and the insulation plate 100 may be more stably fixed to the backpressure assembly 80.

Unlike the embodiments described above, the insulation plate 100 may not be configured as a component separate from the compression device 50 or the backpressure assembly 80, but may be integrated with the compression device 50 or the backpressure assembly 80. The insulation plate 100 may extend from the compression device 50 or the backpressure assembly 80 in a direction increasing the diameter thereof.

Figure 18:
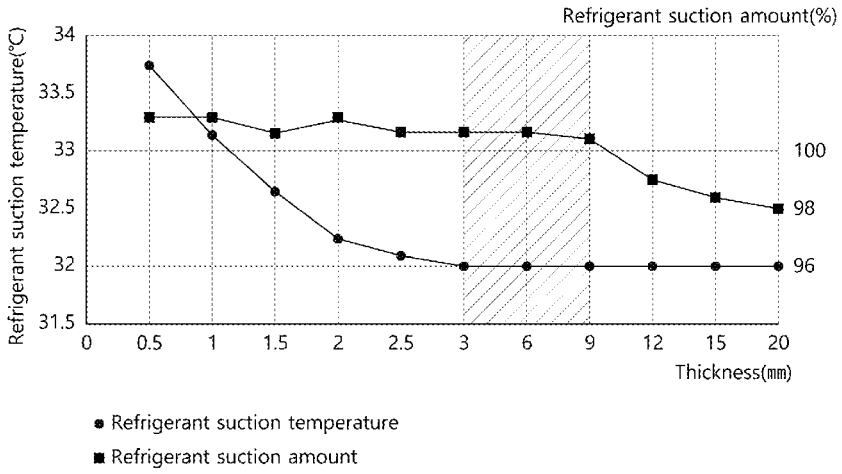
FIG. 18 is a graph illustrating changes in refrigerant suction temperature and refrigerant suction amount when changing a thickness of the insulation plate according to embodiments.

FIG. 18 is a graph illustrating changes in refrigerant suction temperature and refrigerant suction amount when changing a thickness of the insulation plate 100. The term "refrigerant suction temperature" refers to a temperature of refrigerant gas introduced through suction tube 12. The fact that the temperature of the introduced refrigerant gas is high may mean that the temperature of the refrigerant suction space V1 is high, and thus, the temperature of the refrigerant gas is increased after being introduced.

In this test, the entire insulation plate 100 had a predetermined thickness, and was made of synthetic resin. As illustrated in the graph, as the thickness of the insulation plate 100 increases, the temperature of the introduced refrigerant gas gradually decreases. This means that as the thickness of the insulation plate 100 increases, high temperature heat inside of the refrigerant discharge space V3 is prevented from being transferred to the refrigerant suction space V1.

However, when the thickness of the insulation plate 100 reaches at least 3 mm, the temperature of the refrigerant gas does not decrease any further, but rather maintains a predetermined level. That is, when the thickness of the insulation plate 100 reaches at least 3 mm, a heat transfer prevention function of the refrigerant discharge space V3 may not be improved any further, but may be maintained constant.

As the thickness of the insulation plate 100 is gradually increased, a volume of the refrigerant suction space V1 may be inevitably decreased gradually. The decrease in the volume may affect the refrigerant suction amount. As illustrated in the graph, when the thickness of the insulation plate 100 reaches at least 9 mm, the refrigerant suction amount gradually decreases.

As a result, the insulation plate 100 may be made of synthetic resin and may have a thickness of 3 mm to 9 mm. Alternatively, the insulation plate 100 may be made of a non-ferrous metal which has a low heat transfer coefficient and is light in weight.

Figure 19:
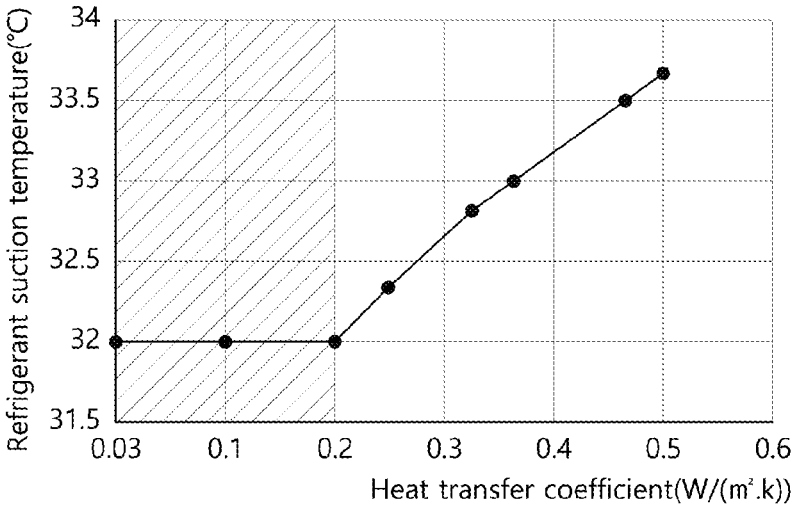
FIG. 19 is a graph illustrating change in refrigerant suction temperature when changing a heat transfer coefficient of the insulation plate according to embodiments.

FIG. 19 is a graph illustrating change in refrigerant suction temperature when changing a heat transfer coefficient of the insulation plate 100. In this test, the insulation plate 100 was made of various materials having different heat transfer coefficients and tested. The unit of the heat transfer coefficient is $W/(m^2K)$, and as the heat transfer coefficient increases, high temperature heat inside of the refrigerant discharge space V3 may be efficiently transferred to the refrigerant suction space V1.

As illustrated in the graph, as the heat transfer coefficient of the insulation plate 100 increases, the refrigerant suction temperature gradually increases. However, until the heat transfer coefficient reaches 0.2 $W/(m^2K)$, the refrigerant suction temperature may be maintained constant. Accordingly, the heat transfer coefficient of the insulation plate 100 may be 0.2 $W/(m^2K)$ or less.

Next, a discharge process of refrigerant will be described with reference to FIG. 1. The refrigerant may be compressed in the compression device 50 and have a high temperature and high pressure, and may be discharged through the discharge hole 67 of the fixed scroll 60. In this case, when the compression chamber of the compression device 50 communicates with a backpressure hole (not shown) of the fixed scroll 60, a portion of the refrigerant gas flowing through the compression chamber of the compression device 50 may be introduced to intermediate pressure flow path 83*c* of the backpressure plate 82 before reaching the discharge hole 67. Accordingly, the intermediate pressure may be applied to the backpressure chamber 84 defined by the backpressure plate 82 and the backpressure piston 81. Accordingly, the backpressure plate 82 may be pressurized downward, and the backpressure piston 81 may be pressurized upward.

When the backpressure piston 81 is pressurized upward, the backpressure piston 81 may move upward. The sealing end 86 may be in contact with the lower end of the high/low pressure separation plate 90 and the backpressure piston 81 may prevent the refrigerant gas from leaking from the refrigerant discharge space V3 to the refrigerant suction space V1. In addition, the pressure of the backpressure chamber 84 may push the fixed scroll 60 toward the orbiting scroll 70, and may prevent leakage of the refrigerant gas between the fixed scroll 60 and the orbiting scroll 70.

In this state, the compressed refrigerant gas may be discharged to the refrigerant discharge space V3 through the discharge hole 67. The discharge hole 67 may be connected to the backpressure hole 87 of the backpressure assembly 80, which is installed at the upper portion of the discharge hole 67, and to the communication hole 92' of the high/low pressure separation plate 90 on the backpressure hole 87. The refrigerant gas may be discharged to the refrigerant discharge space V3 through the discharge hole 67, the backpressure hole 87, and the communication hole 92'. The refrigerant gas may finally be discharged to the outside through the discharge tube 14 connected to the refrigerant discharge space V3.

In this case, the refrigerant discharge space V3 located at the upper portion of the high/low pressure separation plate 90 may have a very high temperature due to the refrigerant gas having a high temperature and high pressure, and when the heat of the refrigerant discharge space affects the lower side thereof, that is, the refrigerant suction space V1, efficiency of the compressor may decrease. However, in embodiments, the insulation space V2 may be defined between the insulation plate 100 and the high/low pressure separation plate 90, and may reduce heat transfer between the refrigerant discharge space V3 and the refrigerant suction space V1.

More specifically, the insulation plate 100 may be provided to block the high/low pressure separation plate 90 and the suction tube 12 from each other by being located therebetween such that the insulation space V2 is defined between the insulation plate 100 and the high/low pressure separation plate 90. The insulation space V2 may be regarded as an intermediate area located between the refrigerant suction space V1 and the refrigerant discharge space V3, and may be regarded as a kind of a buffer space of the heat transfer. Such insulation space V2 may prevent the high temperature of the refrigerant discharge space V3 from being transferred directly to the refrigerant suction space V1.

Temperatures inside of the refrigerant suction space V1, the insulation space V2, and the refrigerant discharge space V3 are high in the following order: the refrigerant discharge space V3>the insulation space V2>the refrigerant suction space V1. The temperature of the refrigerant suction space V1 may be the lowest, and the temperature of the refrigerant discharge space V3 may be the highest.

As a result, the refrigerant gas introduced into the suction tube 12 may be introduced to the refrigerant suction space V1 and in a state in which the temperature of the refrigerant gas does not increase greatly, may be introduced to the compression chamber of the compression device 50. Accordingly, the temperature of the introduced refrigerant gas may be maintained low, and thus, suction volume efficiency may be improved, and as a result, efficiency of the compressor may be increased.

Accordingly, embodiments have been made keeping in mind problems occurring in the related art, and the embodiments provide a compressor which may reduce heat transfer between a refrigerant discharge space located at an upper portion of a high/low pressure separation plate of a compressor and a refrigerant suction space located at a lower portion of the high/low pressure separation plate. In addition, embodiments provide a compressor, in which an insulation plate having a simple structure may be used to reduce heat transfer between the refrigerant discharge space and the refrigerant suction space. Further, embodiments provide a compressor which provides a structure capable of being applied to an existing compressor without changing the design thereof.

Embodiments disclosed herein provide a compressor that may include a casing that connects a suction tube, through which refrigerant may be introduced, to a discharge tube, through which the refrigerant may be discharged, and a compression device installed inside of the casing and that compresses the refrigerant while rotating by receiving a rotational force of an electric motor through a rotational shaft. A high/low pressure separation plate may be installed at an upper part or portion of the compression device, and an insulation plate may be provided to block the high/low pressure separation plate and the suction tube from each other by being located therebetween. The insulation plate may reduce heat transfer between a refrigerant discharge space having a high temperature located at an upper part or portion of the high/low pressure separation plate and a refrigerant suction space having a relatively low temperature located at a lower part or portion of the high/low pressure separation plate.

In addition, a first end of the insulation plate may be connected to the compression device or a backpressure assembly located at a center of the insulation plate, and a second end of the insulation plate may extend toward an inner surface of the casing. Accordingly, when the insulation plate is fitted over the compression device or the backpressure assembly, the refrigerant discharge space and the refrigerant suction space may be naturally separated from each other.

The insulation plate may include a circular insulation body having a connection hole formed therethrough at a center thereof, and a first connection end and a second connection end provided on opposite ends of the insulation body. The first connection end may be provided along an outer edge of the insulation body and face the inner surface of the casing, and the second connection end may be provided along an edge of the connection hole of the insulation body and may be connected to an outer surface of the compression device or of the backpressure assembly. Accordingly, the insulation plate may greatly reduce heat transfer between the upper and lower parts thereof with only a simple structure.

The first connection end may be located at a position lower than the second connection end along an axial direction of the rotational shaft. When the first connection end is located at the position lower than the second connection end, the insulation body of the insulation plate may have a shape that inclines downward, and may correspond to the shape of the high/low pressure separation plate. Accordingly, the insulation plate may be installed closer to the high/low pressure separation plate, and a volume of the refrigerant suction space located under the insulation plate may be increased.

In addition, a predetermined space may be defined between the first connection end of the insulation plate and the inner surface of the casing. The space may prevent the insulation plate from being broken or damaged.

At least a portion of the second connection end of the insulation plate may extend toward the high/low pressure separation plate along the axial direction of the rotational shaft so as to be in surface contact with an outer circumferential surface of the compression device or of the backpressure assembly. Accordingly, a contact area between the second connection end and the outer circumferential surface of the compression device or the backpressure assembly may be increased, so the insulation plate may be more stably fixed to the compression device or the backpressure assembly.

The insulation body of the insulation plate may have a circular shape forming a closed curve by surrounding the compression device or the backpressure assembly. Accordingly, when the insulation plate is fitted over the compression device or the backpressure assembly toward a lower part or portion thereof from an upper part or portion thereof, the insulation plate may be simply assembled with the compression device or the backpressure assembly.

The insulation body of the insulation plate may be composed of at least two parts or portions different from each other in angles relative to the axial direction of the rotational shaft. In this case, the insulation plate may have improved rigidity and may be prevented from being damaged by high temperature or vibration.

A connection guide may protrude from the insulation plate toward at least one of an overheat prevention unit or a pressure control unit both provided on the high/low pressure separation plate. The connection guide may connect the overheat prevention unit or the pressure control unit to the refrigerant suction space located under the insulation plate. Accordingly, although the insulation plate is used, the existing overheat prevention unit or pressure control unit may be used as it is.

The insulation plate may be integrated with the compression device or the backpressure assembly, and may extend in a direction increasing a diameter of the compression device or the backpressure assembly. Additionally, a reinforcing rib may be provided on the insulation plate in a direction connecting the first connection end portion and the second connection end portion of the insulation plate to each other. The reinforcing rib may improve a rigidity of the insulation plate.

Multiple through holes may be formed in the insulation plate, and may communicate an insulation space with the refrigerant suction space located under the insulation plate. In this case, the insulation space may be prevented from being vacuumized by the through holes, and operation of the backpressure assembly may be more efficiently performed.

A guide part or guide may be provided in the insulation plate, the guide part being fixed to the compression device or the backpressure assembly and preventing rotation of the insulation plate. The guide part may prevent rotation of the insulation plate.

A holding hook may be formed on the second connection end, the holding hook being elastically transformed in a direction extending away from the compression device or the backpressure assembly, so that the holding hook is held in an upper step provided on the outer circumferential surface of the compression device or of the backpressure assembly. The holding hook may be provided with multiple holding hooks along a circumferential direction of the second connection end.

In addition, a lower holding part or holder may be formed on the second connection end, the lower holding part extending in a direction opposite to the holding hook. The lower holding part may be held in a lower step provided on the outer circumferential surface of the compression device or of the backpressure assembly. Accordingly, the second connection end may be fixed to the compression device or the backpressure assembly at two positions of different heights of the second connection end part.

The insulation plate may be made of a synthetic resin, and may have a thickness of 3 mm to 9 mm. A heat transfer coefficient of the insulation plate may be 0.2 $W/(m^2K)$ or less. In this case, the insulation plate may have an appropriate thickness and material, and may increase a heat transfer prevention function.

The compressor according to embodiments disclosed herein may have at least the following advantages.

In the compressor according to embodiments, the insulation plate may be installed between the suction tube through which refrigerant is introduced and the high/low pressure separation plate, and may block the suction tube and the high/low pressure separation plate from each other by being located therebetween. Accordingly, heat transfer may be reduced between the refrigerant discharge space having a high temperature located at the upper portion of the high/low pressure separation plate and the refrigerant suction space having relatively a low temperature located at the lower portion of the high/low pressure separation plate, and a temperature of the introduced refrigerant gas may be prevented from rising. As the temperature of the introduced refrigerant gas is maintained low, a suction volume efficiency may be improved, and as a result, efficiency of the compressor may be increased.

More particularly, in the compressor according to embodiments, the insulation plate blocking a high temperature portion (refrigerant discharge space) and a low temperature portion (refrigerant suction space) from each other by being located therebetween may be configured to have a simple structure of a plate shape, thereby simplifying an inner structure of the compressor and increasing suction volume efficiency.

In addition, in the compressor according to embodiments, the insulation plate may be configured to be fitted over the outer circumferential surface of the compression device or of the backpressure assembly, and may be applied to an existing compressor without changing the design thereof. Accordingly, the compressor according to embodiments may have high compatibility with existing compressors, and may improve efficiency thereof at a relatively low cost.

Additionally, in the compressor according to embodiments, the insulation plate may extend by changing an inclination angle from the first end thereof connected to the compression device or the backpressure assembly to the second end thereof directed toward the inner surface of the casing, thereby improving a pressure resistance of the insulation plate. Further, the connection guide may be provided in the insulation plate according to embodiments, and may connect the overheat prevention unit or the pressure control unit provided on the high/low pressure separation plate to the refrigerant suction space located under the insulation plate. Accordingly, the connection guide may maintain functions of the existing overheat prevention unit and pressure control unit and may allow insulation to be performed between the high temperature portion (refrigerant discharge space) and the low temperature portion (refrigerant suction space).

Further, according to embodiments, the guide (the holding hook) may be provided in the insulation plate and fixed to the compression device or the backpressure assembly, so the insulation plate may maintain a predetermined angle relative to the compression device or the backpressure assembly without rotating relative thereto. Such a guide (the holding hook) may use a step provided on the outer surface of an existing compression device or backpressure assembly. Accordingly, due to a simple structure, the insulation plate may have increased installation stability.

The predetermined space may be defined between the first connection end of the insulation plate and the inner surface of the casing, so even during assembly, such as welding, of the casing of the compressor in a high temperature environment, the insulation plate may be prevented from being damaged. The predetermined space may be defined between the first connection end of the insulation plate and the inner surface of the casing, or the through hole may be formed through the insulation plate, whereby the insulation space between the insulation plate and the high/low pressure separation plate may be prevented from being vacuumized, and a back chamber piston of the backpressure assembly may be efficiently moved up and down. Accordingly, in spite of the installation of the insulation plate, operating reliability of the compressor may be prevented from deteriorating.

In the above description, according to embodiments are not necessarily limited to these embodiments, although all elements constituting the embodiments are described as being combined or operating in combination. That is, within the scope, all of the components may be selectively combined to operate in one or more. In addition, the terms "include", "constitute", or "having" described above mean that the corresponding component may be inherent unless otherwise stated. Accordingly, it should be construed that other components may be further included instead of being excluded. All terms, including technical and scientific terms, have the same meaning as commonly understood by ones of ordinary skills in the art to which the present disclosure belongs unless otherwise defined. Commonly used terms, such as those defined in a dictionary, should be construed as consistent with the contextual meaning of the related art and shall not be construed in an ideal or excessively formal sense unless explicitly defined in the present disclosure.

The above description is merely illustrative of the technical idea, and those skilled in the art to which embodiments belongs may make various modifications and changes without departing from the essential characteristics. Accordingly, the embodiments disclosed herein are not intended to limit the technical spirit, but to describe embodiments, and the scope of the technical spirit is not limited by these embodiments. The scope of protection should be interpreted by the following claims, and all technical ideas within the scope should be construed as being included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a casing having a suction tube through which refrigerant is introduced into the casing and a discharge tube through which the refrigerant is discharged from the casing;

a compression device including an electric motor, a rotational shaft, and a compression chamber, wherein the compression device is installed inside of the casing and compresses the refrigerant in the compression chamber while rotating by receiving a rotational force of the electric motor through the rotational shaft;

a high/low pressure separation plate installed at an upper side of the compression device and that separates a refrigerant suction space from a refrigerant discharge space, the refrigerant suction space being connected to the suction tube and the refrigerant discharge space being connected to the discharge tube; and an insulation plate that blocks the high/low pressure separation plate and the suction tube from each other by being located therebetween inside of the casing such that an insulation space is defined between the insulation plate and the high/low pressure separation plate, wherein a first end of the insulation plate is connected to the compression device located at a center of the insulation plate, and a second end of the insulation plate extends toward an inner surface of the casing.

2. The compressor of claim 1, wherein the insulation plate comprises:

a circular insulation body having a connection hole formed through the center thereof;

a first connection end provided along an outer edge of the insulation body and facing the inner surface of the casing; and a second connection end provided along an edge of the connection hole of the insulation body and connected to an outer surface of the compression device.

3. The compressor of claim 2, wherein the first connection end is located at a position lower than the second connection end along an axial direction of the rotational shaft.

4. The compressor of claim 2, wherein a holding hook is formed on the second connection end, the holding hook being elastically transformed in a direction away from the compression device, and being held in an upper step located on an outer circumferential surface of the compression device, and wherein the holding hook comprises multiple holding hooks provided along a circumferential direction of the second connection end.

5. The compressor of claim 4, wherein a lower holder is formed on the second connection end, the lower holder extending in a direction opposite to the holding hook, wherein the lower holder is held in a lower step formed on the outer circumferential surface of the compression device or of the backpressure assembly.

6. The compressor of claim 1, wherein a predetermined space is defined between a first connection end of the insulation plate and the inner surface of the casing.

7. The compressor of claim 6, wherein at least a portion of a second connection end of the insulation plate extends toward the high/low pressure separation plate along an axial direction of the rotational shaft so as to be in surface contact with an outer circumferential surface of the compression device.

8. The compressor of claim 1, wherein an insulation body of the insulation plate has a circular shape forming a closed curve surrounding the compression device.

9. The compressor of claim 1, wherein an insulation body of the insulation plate is composed of at least two portions different from each other in angles relative to an axial direction of the rotational shaft.

10. The compressor of claim 1, wherein a connection guide protrudes from the insulation plate toward at least one of an overheat prevention unit and a pressure control unit both provided on the high/low pressure separation plate, the connection guide connecting the overheat prevention unit or the pressure control unit to the refrigerant suction space located under the insulation plate.

11. The compressor of claim 1, wherein the insulation plate is integrated with the compression device, and extends in a direction increasing a diameter of the compression device.

12. The compressor of claim 1, wherein at least one reinforcing rib is provided on the insulation plate in a direction connecting a first connection end and a second connection end of the insulation plate to each other.

13. The compressor of claim 1, wherein multiple through holes are formed in the insulation plate, through which the insulation space and the refrigerant suction space located under the insulation plate communicate.

14. The compressor of claim 1, wherein a guide is provided in the insulation plate, the guide being fixed to the compression device and preventing rotation of the insulation plate.

15. The compressor of claim 1, wherein the insulation plate is made of synthetic resin or non-ferrous metal and has a thickness of 3 mm to 9 mm.

16. The compressor of claim 1, wherein a heat transfer coefficient of the insulation plate is 0.2 $W/(m^2K)$ or less.

17. The compressor of claim 1, wherein the compressor is a scroll compressor, and the compression device further comprises a fixed scroll and an orbiting scroll.

18. A compressor, comprising:

a casing having a suction tube through which refrigerant is introduced into the casing and a discharge tube though which the refrigerant is discharged from the casing;

a compression device including an electric motor, a rotational shaft, and a compression chamber, wherein the compression device is installed inside of the casing and compresses the refrigerant in the compression chamber while rotating by receiving a rotational force of the electric motor through the rotational shaft;

a backpressure assembly installed at an upper portion of the compression device and having a backpressure piston installed inside of the backpressure assembly, the backpressure piston being configured to move upward and downward in an axial direction of the rotational shaft;

a high/low pressure separation plate installed at an upper portion of the backpressure assembly and that separates a refrigerant suction space from a refrigerant discharge space, the refrigerant suction space being connected to the suction tube and the refrigerant discharge space being connected to the discharge tube; and an insulation plate provided in the casing, at least a portion of the insulation plate surrounding the compression device or the backpressure assembly and allowing an insulation space to be defined between the insulation plate and the high/low pressure separation plate, wherein a first end of the insulation plate is connected to the compression device located at a center of the insulation plate, and a second end of the insulation plate extends toward an inner surface of the casing.

19. The compressor of claim 18, wherein the compressor is a scroll compressor, and the compression device further comprises a fixed scroll and an orbiting scroll.

* * * * *